US012635768B2

(12) United States Patent
Siegismund et al.

(10) Patent No.: US 12,635,768 B2
(45) Date of Patent: May 26, 2026

(54) ARTICLE OF FOOTWEAR HAVING A CLOSURE SYSTEM

(71) Applicant: PUMA SE, Herzogenaurach (DE)

(72) Inventors: Andreas Siegismund, Rueckersdorf (DE); Reinhold Sussmann, Scheinfeld (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 37 days.

(21) Appl. No.: 18/085,090

(22) Filed: Dec. 20, 2022

(65) Prior Publication Data

US 2023/0189933 A1 Jun. 22, 2023

Related U.S. Application Data

(60) Provisional application No. 63/292,284, filed on Dec. 21, 2021.

(51) Int. Cl.

| | |
|---|---|
| ***A43C 1/00*** | (2006.01) |
| ***A43C 11/00*** | (2006.01) |
| ***A43C 11/14*** | (2006.01) |
| ***A43C 11/16*** | (2006.01) |

(52) U.S. Cl.

CPC ..... *A43C 11/1406* (2013.01); *A43C 1/006* (2013.01); *A43C 11/008* (2013.01); *A43C 11/165* (2013.01)

(58) Field of Classification Search

CPC ..... A43C 1/00; A43C 1/003; A43C 1/006; A43C 7/00; A43C 11/008; A43C 11/165

See application file for complete search history.

(56) References Cited

U.S. PATENT DOCUMENTS

| | | | | |
|---|---|---|---|---|
| 5,325,613 | A | 7/1994 | Sussmann | |
| 6,922,917 | B2 * | 8/2005 | Kerns | A43B 5/14 36/50.1 |
| 7,076,843 | B2 * | 7/2006 | Sakabayashi | A43C 11/165 24/68 SK |
| 7,721,468 | B1 * | 5/2010 | Johnson | A43C 1/06 36/118.1 |
| 10,327,513 | B2 | 6/2019 | Soderberg | |
| 10,791,798 | B2 | 10/2020 | Lovett | |
| 10,834,999 | B2 | 11/2020 | Orand | |
| 2006/0156584 | A1 | 7/2006 | Johnson | |
| 2009/0172928 | A1 | 7/2009 | Messmer | |
| 2011/0258876 | A1 * | 10/2011 | Baker | A43C 11/1493 36/50.1 |

(Continued)

FOREIGN PATENT DOCUMENTS

| | | | |
|---|---|---|---|
| EP | 1421867 | A1 | 5/2004 |
| EP | 4052604 | A1 | 9/2022 |
| WO | 2009068503 | A1 | 6/2009 |

OTHER PUBLICATIONS

International Search Report with Written Opinion mailed Mar. 13, 2023 from PCT/IB2022/062550 (19 pages).

*Primary Examiner* — Sharon M Prange

(74) *Attorney, Agent, or Firm* — Quarles & Brady LLP

(57) ABSTRACT

A closure system for an article of footwear includes a reel and a cord that is configured to be operably engaged with an upper of the footwear. A first segment of the cord is attached to the reel, and the reel is configured to be actuated by pulling the first segment of the cord to tighten the footwear.

18 Claims, 4 Drawing Sheets

(56) References Cited

U.S. PATENT DOCUMENTS

| | | | | |
|---|---|---|---|---|
| 2015/0289595 | A1* | 10/2015 | Rushbrook | A43C 11/008 36/50.1 |
| 2017/0105489 | A1* | 4/2017 | Lovett | A43C 1/04 |
| 2017/0215525 | A1* | 8/2017 | Labbe | A43C 7/08 |
| 2018/0352898 | A1* | 12/2018 | Onoda | A43B 7/1475 |
| 2019/0343233 | A1* | 11/2019 | Rankin | A43B 3/34 |
| 2020/0085144 | A1* | 3/2020 | Chiou | A43C 11/165 |
| 2022/0007793 | A1* | 1/2022 | Bidal | A43C 1/003 |
| 2022/0031024 | A1* | 2/2022 | Cook | A43B 5/14 |

* cited by examiner

ARTICLE OF FOOTWEAR HAVING A CLOSURE SYSTEM

CROSS-REFERENCE TO RELATED APPLICATIONS

This application claims priority to and the benefit of U.S. Provisional Application No. 63/292,284, filed on Dec. 21, 2021, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a fastening system or closure system.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with improved closure mechanisms.

SUMMARY

An article of footwear, as described herein, may have various configurations. The article of footwear may have an upper and a sole structure connected to the upper.

In some aspects, a closure system for an article of footwear includes a reel and a cord that is configured to be operably engaged with an upper of the footwear. A first segment of the cord is attached to the reel, and the reel is configured to be actuated by pulling the first segment of the cord to tighten the footwear.

In another aspect, an article of footwear includes a sole attached to an upper that has an outer layer and a base layer. Further, the article of footwear includes a closure system having a reel and a cord. The cord has a first segment and a second segment, with the first segment being configured to actuate the closure system. The second segment of the cord is configured to be retrieved by the closure system and the first segment of the cord is operably coupled to the second segment of the cord by the reel.

In still another aspect, a closure system for an article of footwear includes a reel, a cord, and a wrap that is operably coupled to the reel by the cord. The wrap is operably coupled to the reel to tighten the article of footwear.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

Figure 1:
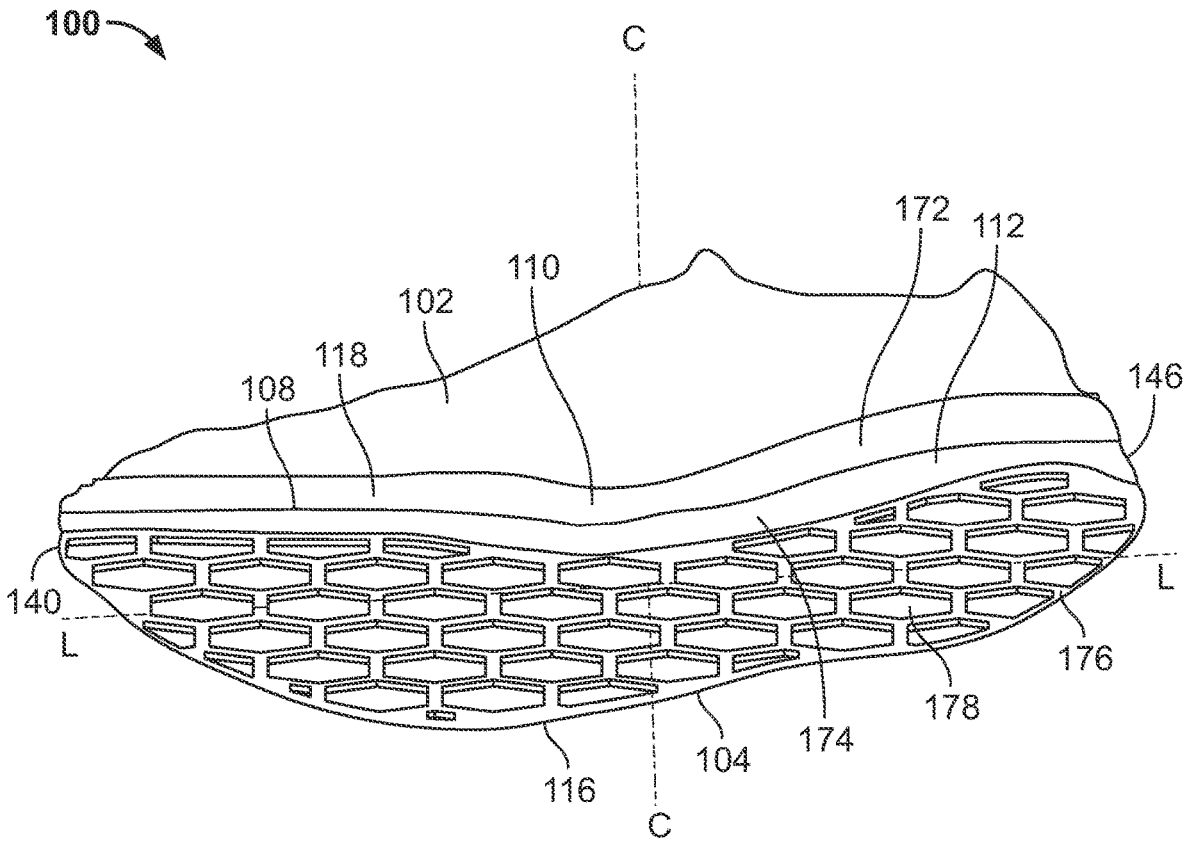
FIG. 1 is a perspective view of a bottom and medial side of an article of footwear configured as a right shoe that includes an upper and a sole structure, according to an embodiment of the disclosure.
Figure 2:
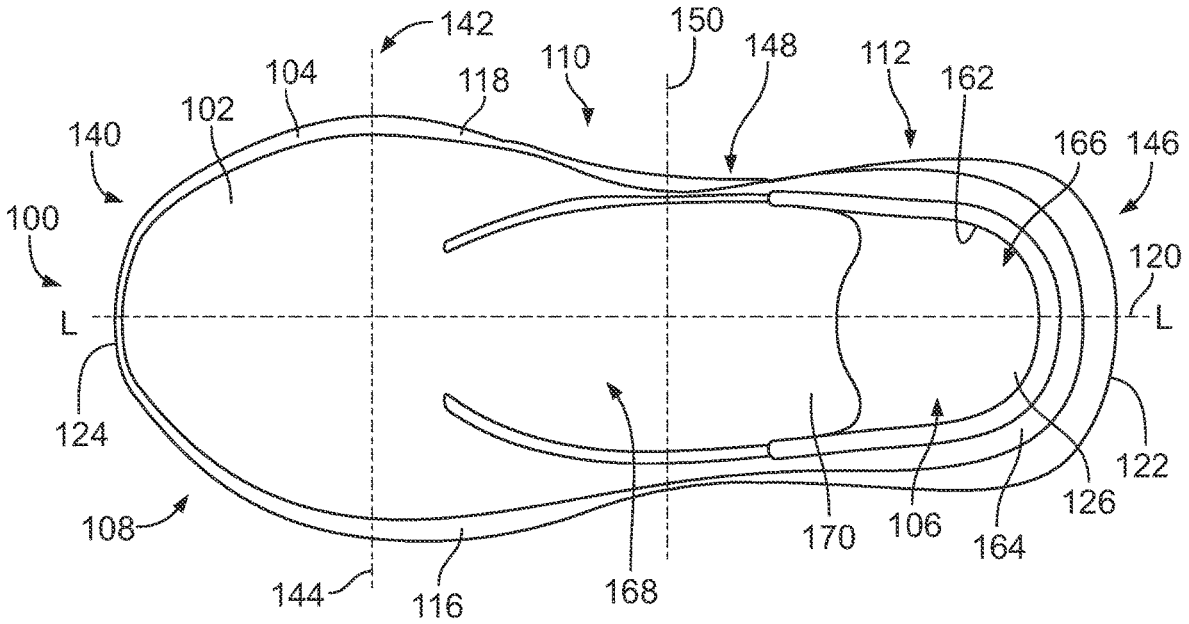
FIG. 2 is a top view of the article of footwear of FIG. 1.
Figure 3:
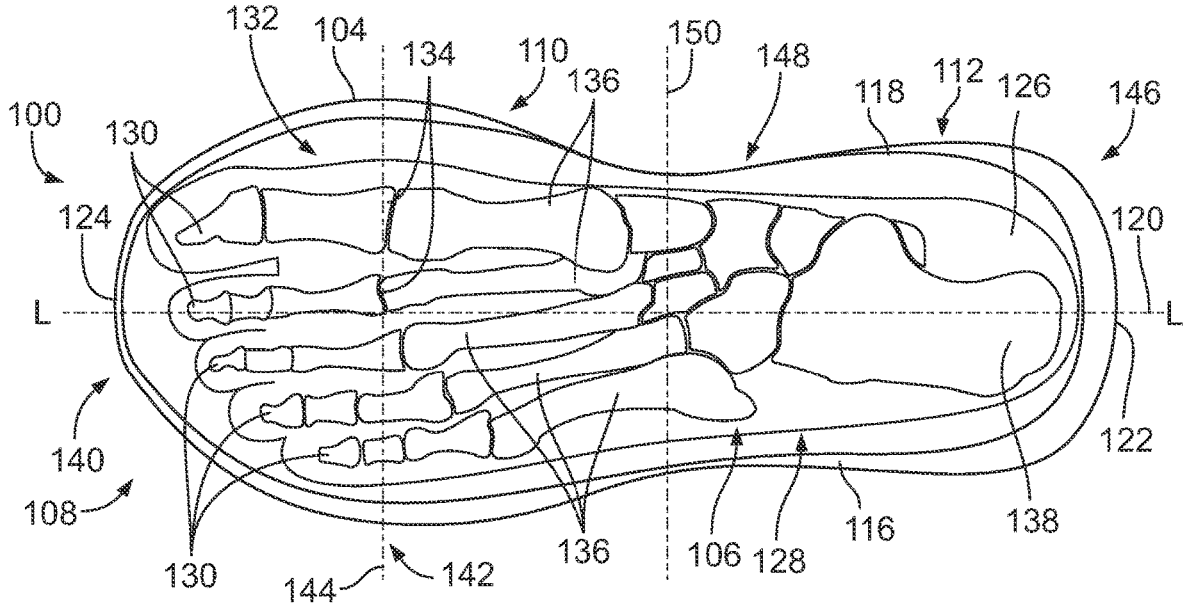
FIG. 3 is a top plan view of the article of footwear of FIG. 1, with an upper removed and a user's skeletal foot structure overlaid thereon.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics FIGS. 1-3 depict an exemplary embodiment of an article of footwear 100 including an upper 102 and a sole structure 104. The upper 102 is attached to the sole structure 104 and together define an interior cavity 106 (see FIGS. 2 and 3) into which a foot may be inserted For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements, e.g., textiles, polymer foam, polymer sheets, leather, and synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity 106 of the upper 102, which can be in direct contact with a user's foot while an article of footwear 100 is being worn. Moreover, the upper 102 may also include a liner (not shown) that can increase comfort, for example, by reducing friction between the foot of the user and the upper 102, the sole 104, the insole, or the like, and/or by providing moisture wicking properties. The liner may line the entirety of the interior cavity 106 or only a portion thereof. In some embodiments, a binding (not shown) may surround an opening of the interior cavity 106 to secure the liner to the upper 102 and/or to provide an aesthetic element on the article of footwear 100.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral sides 116 and medial sides 118. The medial side 118 and the lateral side 116 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the medial side 118 and the lateral side 116 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of the foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the medial side 118, and the lateral side 116 are intended to define boundaries or areas of the article of footwear 100. To that end, the forefoot region 108, the midfoot region 110, the heel region 112, the medial side 118, and the lateral side 116 generally characterize sections of the article of footwear 100. Certain aspects of the disclosure may refer to portions or elements that are coextensive with one or more of the forefoot region 108, the midfoot region 110, the heel region 112, the medial side 118, and/or the lateral side 116. Further, both the upper 102 and the sole structure 104 may be characterized as having portions within the forefoot region 108, the midfoot region 110, the heel region 112, and/or along the medial side 118 and/or the lateral side 116. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 118 and/or the lateral side 116.

Still referring to FIGS. 2 and 3, the forefoot region 108, the midfoot region 110, the heel region 112, the medial side 118, and the lateral side 116 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 118, and/or the lateral side 116 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 118, and/or the lateral side 116 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 162 and an exterior surface 164. The interior surface 162 faces inward and generally defines the interior cavity 106, and the exterior surface 164 of the upper 102 faces outward and generally defines an outer perimeter or boundary of the upper 102. The upper 102 also includes an opening 166 that is at least partially located in the heel region 112 of the article of footwear 100, which provides access to the interior cavity 106 and through which a foot may be inserted and removed. In some embodiments, the upper 102 may also include an instep region 168 that extends from the opening 166 in the heel region 112 over an area corresponding to an instep of a foot to an area proximate the forefoot region 108. The instep region 168 may comprise an area similar to where a tongue 170 of the present embodiment is disposed. In some embodiments, the upper 102 does not include the tongue 170, i.e., the upper 102 is tongueless.

In the illustrated embodiment, the sole structure 104 includes a midsole 172 and an outsole 174. The outsole 174 may define a bottom end or bottom surface 176 of the sole structure 104 across the heel region 112, the midfoot region 110, and the forefoot region 108. Further, the outsole 174 may be a ground-engaging portion or include a ground-engaging surface of the sole structure 104 and may be opposite of the insole thereof. As illustrated in FIG. 1, the bottom surface 176 of the outsole 174 may include a tread pattern 178 that can include a variety of shapes and configurations. The outsole 174 may be formed from one or more materials to impart durability, wear-resistance, abrasion resistance, or traction to the sole structure 104. In some embodiments, the outsole 174 may be formed from any kind of elastomer material, e.g., rubber, including thermoset elastomers or thermoplastic elastomers, or a thermoplastic material, e.g., thermoplastic polyurethane (TPU). In some embodiments, the outsole 174 may define a shore A hardness up to 95. In addition, the outsole 174 may be manufactured by a process involving injection molding, vulcanization, printing layer by layer, i.e., additive manufacturing systems or methods, and the like.

Still referring to FIG. 1, the midsole 172 may be individually constructed from a thermoplastic material, such as polyurethane (PU), for example, and/or an ethylene-vinyl acetate (EVA), copolymers thereof, or a similar type of material. In other embodiments, the midsole 172 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 172 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 172 is manufactured by a process involving injection molding, vulcanization, printing layer by layer, i.e., additive manufacturing systems or methods, and the like.

In embodiments where the midsole 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 172 may be formed using alternative methods known in the art, including the use of an expansion press, an injection machine, a pellet expansion process, a cold foaming process, a compression molding technique, die cutting, or any combination thereof. For example, the midsole 172 may be formed using a process that involves an initial foaming step in which supercritical gas is used to foam a material and then compression molded or die cut to a particular shape.

Figure 4:
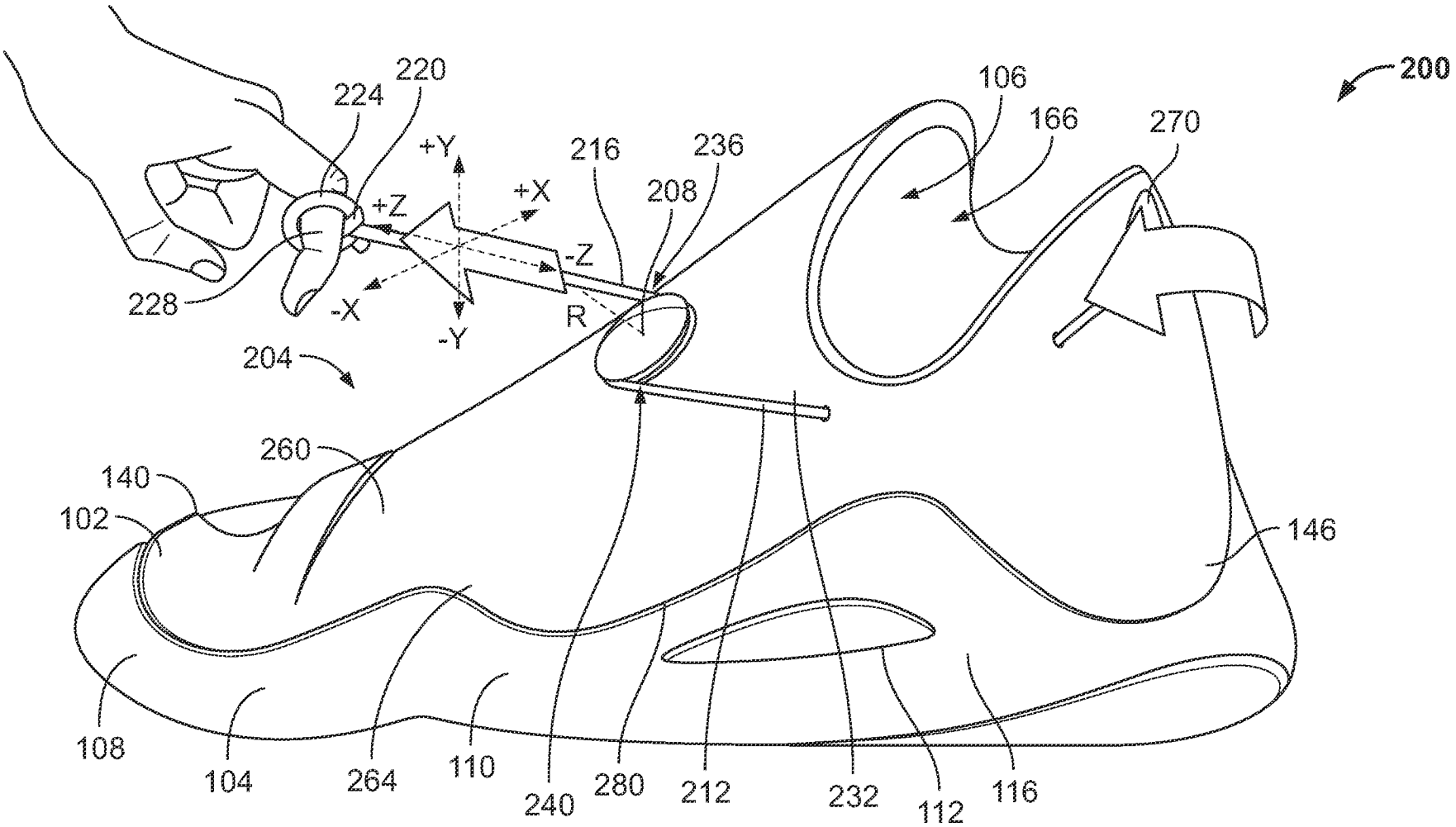
FIG. 4 is a schematic representation of a perspective view of a lateral and heel side of an article of footwear configured as a left shoe, according to an embodiment of the disclosure.

FIG. 4 depicts a schematic representation of an article of footwear 200 having a fastening system or closure system 204 that includes a closure mechanism in the form of a reel 208 that is operably engaged with a cord 212 to tighten and/or loosen the article of footwear 200 around a user's foot. In the illustrated embodiment, the reel 208 is mounted to the upper 102 of the footwear 200 on the lateral side 116 and within the midfoot region 110 and/or the heel region 112, although other configurations are possible. The cord 212 includes a first segment 216 that is configured to be pulled or drawn by a user away from the reel 208 to actuate the closure system 204. In the illustrated embodiment, the first segment 216 of the cord 212 includes a free end 220 having a ring 224 through which a finger 228 of a user can be inserted to facilitate manipulation, e.g., pulling, of the cord 212 away from the reel 208. In addition, a second segment 232 of the cord 212 extends between the reel 208 and the upper 102 and/or the sole 104. The second segment 232 is operably engaged with the reel 208 and, further, connects the reel 208 to the upper 102 and/or the sole 104 to transmit a tensional force thereon for tightening the footwear 200 around a user's foot. In particular, when the closure system 204 is actuated to tighten the footwear 200, the reel 208 acts upon the second segment 232 of the cord 212 by rotating about the rotational axis R, which in turn causes a portion of the second segment 232 of the cord 212 to be retrieved by the reel 208. Because the second segment 232 of the cord 212 is coupled to the upper 102 and/or the sole 104, the tensional force caused by rotation of the reel 208 is transmitted thereto.

It is contemplated that the first segment 216 and the second segment 232 of the cord 212 may be provided as separate, distinct cords that are operably coupled by the reel 208. In some embodiments, the first segment 216 extends from a first opening 236 of the reel 208 and the second segment 232 extends from a second opening 240 of the reel 208. The first opening 236 and the second opening 240 are spaced radially apart from one another, such as, e.g., being disposed 180 degrees from one another, about a rotational axis R extending centrally through the reel 208. However, in other embodiments, the first opening 236 and the second opening may be radially spaced apart from one another. In some embodiments, the first segment 216 and the second segment 232 of the cord 212 are integrally formed as part of the same cord 212. For example, the cord 212 may be wrapped around a portion of the reel 208, such that the reel 208 rotates about the rotational axis R in a counterclockwise direction when the first segment 216 is pulled away from the reel 208, thereby tightening the footwear 200. Further, the cord 212 may be formed of a variety of resilient and flexible materials, such as, e.g., elastic or thermoplastic materials, woven or non-woven fabric or fibrous materials, or some combination thereof. It is contemplated that the first segment 216 and the second segment 232 of the cord 212 may be formed of different materials. In addition, it is contemplated that the cord 212 may be provided with varying thicknesses or diameters, cross-sectional shapes, and combinations thereof.

As illustrated in FIG. 4, the first segment 216 of the cord 212 may be pulled away from the reel 208 to actuate the closure system 204 for tightening and/or loosening the footwear 200 around the user's foot. For reference purposes, an imaginary coordinate system is provided with three axes X, Y, Z that are each disposed orthogonally relative to one another and defining opposing directions, e.g., being denoted positive (+) and negative (−). In the illustrated embodiment, the first segment 216 of the cord 212 is pulled outwardly away from the reel 208 in a +Z direction, which may be considered a forward or toe-ward direction. It is contemplated that when a user releases the ring 224 and/or the first segment 216 of the cord 212, a return mechanism (not shown) automatically retracts the first segment 216 of the cord 212 toward the reel 208 in the −Z direction, which may be considered a rearward or heel-ward direction. Further, because the reel 208 is illustrated as being disposed on the lateral side 116 of the upper 102, it is contemplated that the first segment 216 of the cord 212 can be pulled outwardly from the reel 208 in some combination of directions indicated by the coordinate system, such as, e.g., in a forward +Z direction and also a lateral-X direction. Consequentially, the first segment 216 of the cord 212 may be retracted automatically toward the reel 208 in a medial +X and heelward direction-Z. To that end, the first segment of the cord 212 is pulled in one or more directions away from the reel 208 to actuate tightening and/or loosening functions of the closure system 204.

In some embodiments, the reel 208 may be actuated in various ways to provide various functionalities. In one aspect, the reel 208 may be configured such that pulling the first segment 216 of the cord 212 in a particular direction actuates a particular function of the reel 208 to achieve a particular output. For example, when the first segment 216 of the cord 212 is pulled primarily in the forward +Z direction, the reel 208 may retrieve the second segment 232 of the cord 212 to tighten the footwear 200; then, when the first segment 216 of the cord 212 is pulled in primarily an upward +Y direction, the reel 208 may become unlocked so as to allow the second segment 232 of the cord 212 to release and become loosened, thereby allowing the footwear 200 to be loosened. Additionally or alternatively, pulling the first segment 216 of the cord 212 in the lateral-X direction or the medial +X direction may adjust a tightening or loosening output of the reel 208, such that subsequent actuation of the reel 208 to retrieve or release the second segment 232 of the cord 212 can be accomplished by pulling the first segment 216 of the cord 212 a greater or smaller distance from the reel 208, or in a different direction, or to impart different tightening or loosening boundaries, i.e., thresholds for tightness tuned depending on the user's preferences. In this way, the first segment 216 of the cord 212 is configured to be pulled away from the reel 208 in a plurality of directions that can be associated with a plurality of functions. To that end, any of the directions −Z, +Z, −X, +X, −Y, and +Y can be considered a first direction that is associated with a first function, e.g., tightening or loosening or releasing or adjusting, and any of the remaining directions −Z, +Z, −X, +X, −Y, and +Y can be considered a second direction that is associated with a second function that is different from the first function.

Further, it is contemplated that the closure system 204 may be provided with a button (not shown) that can be pressed to unlock or adjust the tightening and/or loosening of the footwear 200. For example, once the reel 208 has been actuated to tighten the footwear 200, a user can press the button (not shown), which may be disposed integrally with the reel 208 or on the upper 102 near the reel 208, to cause the closure system 204 to unlock and/or release the tightening force conveyed by the second segment 232 of the cord 212, thereby allowing the user to loosen the footwear 200. In some embodiments, the button (not shown) may be provided as a pair of buttons (not shown) arranged on the upper 102 within the heel region 112, with one disposed on the lateral side 116 and the other disposed on the medial side 118. Often, a user has a natural tendency to grab hold of the heel region 112 of the upper 102 when removing the footwear 200 from the user's foot, such that the thumb and the forefinger are disposed on opposing sides, i.e., lateral and medial, of the footwear 200 to compress and pull the foot from the footwear 200. Taking advantage of this natural tendency, the pair of buttons (not shown) may be disposed in such areas to provide ergonomic, intuitive release of the closure system 204. In some embodiments, the pair of buttons (not shown) may be required to be activated simultaneously, such that pressing only one of the pair of buttons (not shown) would not be sufficient to release the closure system 204.

In another aspect, the closure system 204 may be unlocked and/or released by pulling the first segment 216 of the cord 212 in a predetermined distance away from the reel 208. For example, the reel 208 may be actuated by pulling the first segment 216 of the cord 212 away from the reel 208 a first distance, and subsequent unlocking and/or releasing the closure system 204 may be accomplished by pulling the first segment 216 of the cord 212 away from the reel 208 a second distance that is greater than the first distance. In this way, actuation of the closure system 204 to tighten and loosen the footwear 200 can be accomplished by repetitive, familiar motions that may be particularly suitable for users of a particular age, such as, e.g., children, or users having limited dexterity, or users having limited range of motion and/or flexibility In addition, it is contemplated that the closure system 204 can be provided with several adjustment features for selectively adjusting a parameter with which the footwear 200 can be tightened and loosened. For example, the closure system 204 may be configured to have a variable-ratio gearing system housed within the reel 208, e.g., internal gearing and/or ratcheting components (not shown), such that the closure system 204 offers an adjustable winding ratio WR. Applying the well-known principles of rotational kinematics, i.e., the mechanical principles explaining the radial and linear displacement of a rigid body about a fixed axis, it will be appreciated that the winding ratio WR of the reel 208 can be understood as a proportion between an input parameter and an output parameter to impact tightening and/or loosening of the footwear 200. In one particular aspect, the input parameter is a distance, i.e., length, that the first segment 216 of the cord 212 is pulled away from the reel 208, and the output parameter is a distance, i.e., length, that the second segment 232 of the cord 212 is pulled into or toward the reel 208. To that end, the reel 208 may be set at a 1:1 winding ratio, such that the distance the first segment 216 is pulled away from the reel 208 is equal to the length of the second segment 232 retrieved by the reel 208.

Further, the winding ratio WR may be adjusted to increase or decrease, where an increased winding ratio WR means the distance that first segment 216 is pulled is less than the length of the second segment 232 of the cord 212 retrieved by the reel 208. In some embodiments, the winding ratio WR may range from 1:1, 1.5:1, 2.1, 2.5:1, or more. Because pulling the first segment 216 of the cord 212 requires a user to exert energy, increasing the winding ratio WR reduces the amount of energy required to tighten the footwear 200. In a similar manner, the winding ratio WR may be adjusted down or decreased to allow for finer adjustment of the tightness of the footwear 200. For example, the distance that the first segment 216 is pulled away from the reel is greater than the length that the second segment 232 is retrieved by the reel 208, allowing for smaller adjustments without requiring careful, subtle movements by a user.

It is further contemplated that the winding ratio WR may be adjusted by pulling the first segment 216 of the cord 212 in a particular direction, such as, e.g., increasing the winding ratio WR incrementally from 1:1 to 2:1 or, for example, the reel 208 can be configured to automatically retract the first segment 216 of the cord 212 after being released by a user, as mentioned above. Further, the reel 208 may be provided with an auto-adjust feature that is tuned to impart a constant tightening force or pressure on the second segment 232 of the cord 212, and thus the footwear 200, within a particular range. For example, rather than the reel 208 being set to a particular radial position and locking into place to rely on the shortened distance of the second segment 232 of the cord 212 to maintain the tightness of the footwear 200, the reel 208 may instead have a biasing member (not shown) operably engaged with the second segment 232 of the cord 212 to maintain a tightness setpoint, as desired by the user. In this way, a user can select the tightness setpoint from a range of predetermined setpoints, which may be influenced in part by the distance of the second segment 232 of the cord 212 in combination with the tuning of a biasing member (not shown) to maintain the tightness setpoint while allowing for deviations within a predetermined band or range. In this way, the reel 208 may act as a dial for a user to select a range of tightness of the footwear 200.

As mentioned above, the reel 208 of the closure system 204 may incorporate internal componentry (not shown) to effectuate the tightening and loosening of the footwear 200. Such internal componentry may include, for example, a disc(s) or gear(s), a shaft(s) or spool(s), a biasing mechanism(s) such as a spring or a magnetic element or an elastic member, a ratchet or rack, a fastener(s), and a button(s), among other suitable components. In some embodiments, the reel 208 may be provided with a translucent or transparent housing to expose the internal componentry (not shown). In other embodiments, the reel 208 may be concealed by opaque structures and embedded within the upper 102 and/or the sole 104. Further, it is contemplated that the reel 208 can be configured as a centralized component within a cylindrical-shaped housing, or the reel 208 may be decentralized among various regions or sections of the footwear 200.

Figure 5:
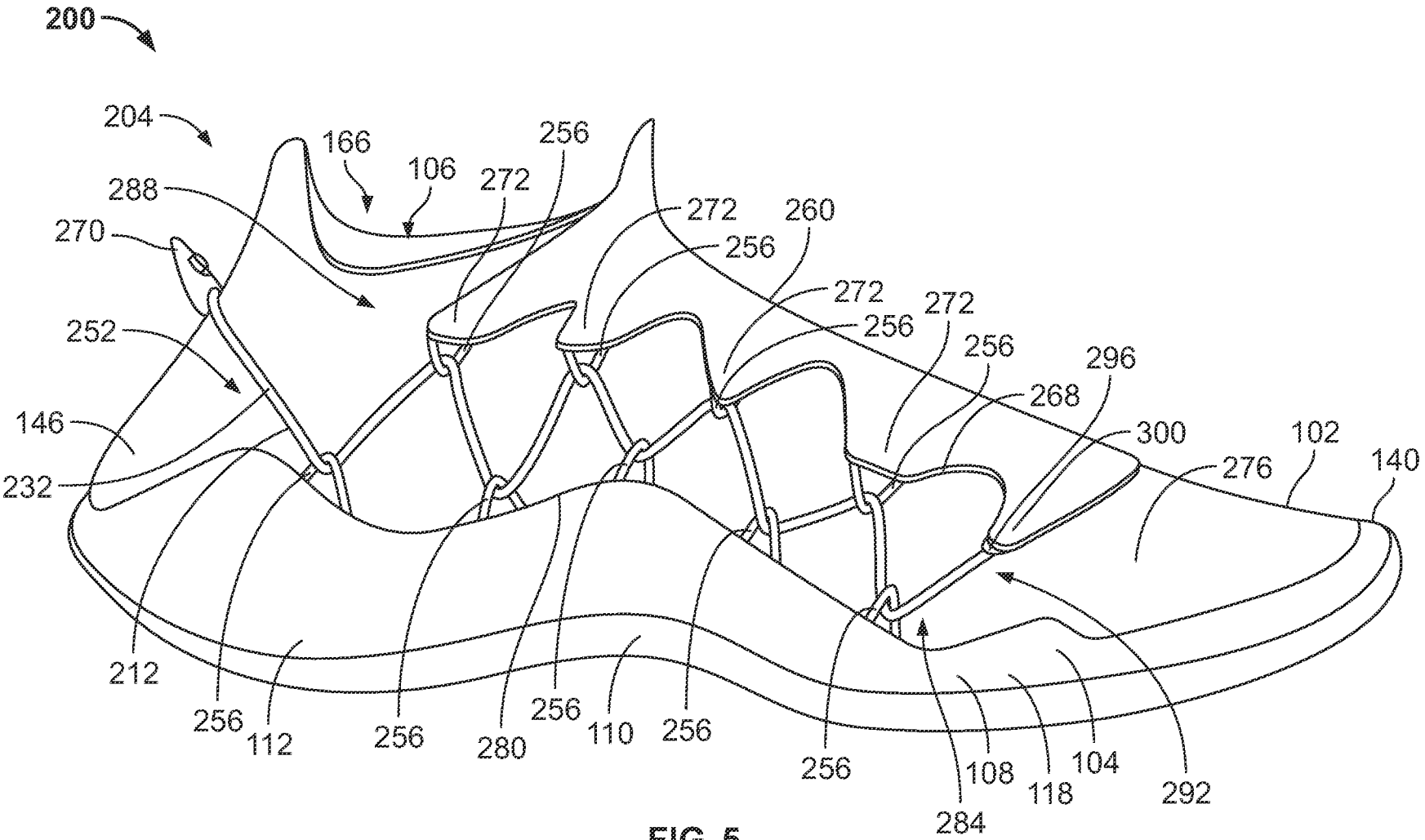
FIG. 5 is a schematic representation of a side elevational view of a medial side of the article of footwear of FIG. 4.

Referring to FIG. 5, the cord 212 is engaged with the upper 102 and the sole 104 within a winding region 252. In the illustrated embodiment, the second segment 232 of the cord extends from the reel 208 in a heel-ward direction along the lateral side 116 in the heel region 112, across the heel end 146 in a curved manner mimicking the shape of the upper 102 at the heel end 146, toward the medial side 118, and into the winding region 252 that extends along the medial side 118 of the footwear 200, although other configurations are possible. Within the winding region 252, the cord 212 engages with a plurality of straps 256 mounted along the upper 102 and the sole 104. In particular, the upper 102 includes an outer layer or wrap 260 extending from a first end 264 disposed on the lateral side 116 of the footwear 200 to a second end 268 disposed on the medial side 118 of the footwear 200 (see FIGS. 4 and 5). In the illustrated embodiment of FIGS. 4 and 5, the first end 264 of the wrap 260 is directly attached to the upper 102 and the sole 104, although other configurations are possible. Further, the second end 268 of the wrap 260 is attached to the upper 102 and the sole 104 by the second segment 232 of the cord 212. Further, the second segment 232 of the cord 212 operably couples the wrap 260 to the reel 208 to tighten the footwear 200. In this way, the wrap 260 is a part of the closure system 204. To that end, the wrap 260 can include a release feature in the form of a tab 270 that, when unfastened, can relieve the tightening force in the wrap 260 to loosen the footwear 200. In addition, a plurality of flaps 272 extend from the second end 268 of the wrap 260 in the form of curved finger-like portions, although other configurations are possible. In the illustrated embodiment, the wrap 260 extends over and along a base layer 276 of the upper 102, as illustrated in FIG. 5. Further, the first end 264 of the wrap 260 contacts the sole 104 along the lateral side 116 of the footwear 200 and the second end 268 of the wrap 260 is spaced apart from the sole 104 along the medial side 118 of the footwear 200. It is contemplated that the tab 270 is fastened to the base layer 276 of the upper 102 in a closed position (see FIG. 4) to maintain the tightening and compression forces exerted by the wrap 260 on the user's foot, and the tab 270 can be unfastened to an open position (see FIG. 5) to release the tightening/compression forces exerted by the wrap 260 on the user's foot. In the illustrated embodiment, the tab 270 is positioned within the heel region 112 at the heel end 146, although other configurations are possible.

As illustrated in FIG. 5, each flap 272 carries one of the straps 256 through which a portion of the cord 212 is received, e.g., looped, guided, or threaded. In addition, the sole 104 has an upper periphery 280 along which the straps 256 are coupled and spaced part from one another, spanning from the heel region 112 to the midfoot region 110 to the forefoot region 108, although other configurations are possible. It is further contemplated that greater or fewer straps 256 may be provided on the footwear 200 within the scope of this disclosure. In the illustrated embodiment, the plurality of straps 256 includes a first set of straps 284 arranged on the sole 104 and a second set of straps 288 arranged on the second end 268 of the wrap 260 of the upper 102. As illustrated in FIG. 5, the first set of straps 284 and the second set of straps 288 are arranged to be spaced apart in an offset pattern relative to one another. In this way, the straps 256 form a winding path 292 for the cord 212 to follow to distribute the tightening force between the upper 102 and the sole 104 along the footwear 200. In the illustrated embodiment, the cord 212 terminates at an anchor 296 on a forwardmost flap 300 of the wrap 260 of the upper 102 within the forefoot region 108, although other configurations are possible.

Referring to FIGS. 4 and 5, the reel 208 may be disposed between the wrap 260 and the base layer 276 of the upper 102 and the second segment 232 of the cord 212 may extend between the wrap 260 and the base layer 276 so as to be partially or entirely concealed. The first segment 216 of the cord 212 may extend through an aperture (not shown) formed in the wrap 260, and the ring 224 may be sized and shaped to be prevented from passing through the aperture. In some embodiments, the wrap 260 is formed of a flexible and resilient material, which may be different from a material used to form the base layer 276 of the upper 102. In some embodiments, the wrap 260 extends continuously from the heel region 112 to the midfoot region 110 to the forefoot region 108 and from the lateral side 116 to the medial side 118 over the base layer 276 of the upper 102. To that end, the wrap 260 is configured to move relative to and independently of the base layer 276 of the upper 102. As the cord 212 causes the wrap 260 to tighten, the wrap 260 distributes a compression force along the base layer 276 of the upper 102, from the lateral side 116 to the medial side 118 and from the heel region 112 to the forefoot region 108 of the footwear 200, which provides a distribution of tightening forces around the user's foot.

It is contemplated that the wrap 260 can be provided in various forms to impart desirable compression forces to the base layer 276 and, thus, to the user's foot. For example, the wrap 260 may be formed of distinct sections having different material properties or compositions. Further, the wrap 260 may be provided with seams or strands (not shown) to guide or direct tensile and/or compression forces toward or away from particular sections or regions of the footwear 200. In addition, the wrap 260 may be provided as an integral piece or as multiple portions coupled or fastened together. Further, the wrap 260 may be directly overlaid on the base layer 276 of the upper 102 or, alternatively, an intermediary substrate or layer can be provided between the wrap 260 and the base layer 276 of the upper 102.

As illustrated in FIG. 5, the wrap 260 may be provided with flaps 272 of varying sizes and shapes that are different from one another. In this way, the flaps 272 of the wrap 260 are configured to control the tightening and/or compression forces exerted from the cord 212 to the wrap 260 to the foot. Further, the flaps 272 can become deformed when the cord 212 exerts a tightening force thereto, such that the flaps 272 are pulled or stretched in different directions across the base layer 276. In this way, the flaps 272 and the wrap 260 are configured to move relative to the base layer 276 to further define and control the winding path 292 of the cord 212, which allows for further distribution of the compression forces along the base layer 276.

It is also contemplated that any of the closure system 204 described herein may incorporate a closure mechanism similar to those disclosed in U.S. Pat. Nos. 5,325,613, 5,600,875, 5,606,778, 5,638,588, 5,651,198, and 5,669,116, which are all commonly assigned to Puma SE and incorporated by reference in their entirety herein. For example, it is contemplated that the reel 208 may be modified to include one or more aspects of the closure mechanisms to provide further tightening or loosening functionality when used with the cord 212 and mounted on the footwear 200 of the present disclosure.

In other embodiments, other configurations are possible. For example, certain features and combinations of features that are presented with respect to particular embodiments in the discussion above can be utilized in other embodiments and in other combinations, as appropriate Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear that has a closure system, wherein the article of footwear includes an upper that is attached to a sole structure, the upper having an opening that is at least partially located in a heel region and provides access to an interior cavity, the closure system comprising:

a reel mounted to the upper on a lateral side of the footwear, wherein the reel is positioned closer to a toe end of the footwear than the opening; and a cord that is configured to be operably engaged with the upper, wherein a first segment of the cord is attached to the reel, and wherein the upper includes an outer layer that is movable relative to a base layer, the outer layer extending from a first end disposed on a lateral side to a second end disposed on a medial side, the first end being directly attached to the sole structure and the second end being attached to the sole structure by a second segment of the cord, wherein the second segment of the cord extends from the reel along the lateral side in the heel region, across a heel end, and along the medial side, wherein the second segment extends between the reel and the upper, and wherein the closure system includes an adjustable winding ratio having an input parameter and an output parameter, the output parameter being associated with the second segment of the cord.

2. The closure system of claim 1, wherein the first segment of the cord is pulled away from the reel and the second segment of the cord is retrieved by the reel.

3. The closure system of claim 1, wherein the second segment of the cord is formed of a different material than the first segment of the cord.

4. The closure system of claim 1, wherein a release feature is provided to unlock the closure system.

5. The closure system of claim 1, wherein a ring is disposed at a free end of the cord.

6. An article of footwear, comprising:

a sole attached to an upper, wherein the upper has an outer layer and a base layer; and a closure system, comprising:

a reel mounted to the upper on a lateral side of the footwear; and a cord, the cord having a first segment and a second segment, wherein the first segment is configured to actuate the closure system, wherein the second segment is configured to be retrieved by the closure system, wherein the first segment is operably coupled to the second segment by the reel, wherein the first segment is configured to be pulled away from the reel in a plurality of different directions that are associated with a plurality of different functions of the closure system, such that pulling the first segment in a first direction actuates a first function of the closure system and pulling the first segment in a second direction actuates a second function of the closure system that is different from the first function, and wherein the outer layer is movable relative to the base layer, the outer layer extending from a first end disposed on the lateral side to a second end disposed on a medial side, the first end being directly attached to the sole and the second end being attached to the sole by the second segment of the cord.

7. The article of footwear of claim 6, wherein the second segment is operably connected to the outer layer of the upper.

8. The article of footwear of claim 6, wherein the second segment is received through a plurality of straps arranged on the outer layer of the upper.

9. The article of footwear of claim 6, wherein the second segment is attached to the sole and the outer layer of the upper along a winding path formed by a plurality of straps that are arranged in an offset pattern along the medial side of the footwear.

10. The article of footwear of claim 6, wherein the outer layer of the upper is configured to move relative to the base layer of the upper when the closure system is actuated.

11. The article of footwear of claim 6, wherein the outer layer is wrapped around a portion of the base layer of the upper.

12. An article of footwear that has a closure system, the closure system comprising:

a reel;

a cord having a first segment and a second segment; and a wrap having a first end disposed on a first side of the footwear and a second end moveably attached to a second side of the footwear, the second end including a plurality of flaps positioned on an opposite side of an opening of the footwear than the reel, the plurality of flaps including a forwardmost flap located in a forefoot region of the footwear, the wrap being operably coupled to the reel by the cord, wherein the wrap is operably coupled to the reel to tighten the article of footwear, wherein the cord terminates at an anchor on the forwardmost flap, wherein the cord extends from the reel along a lateral side in a heel region, across a heel end, and along a medial side, wherein the second segment of the cord extends between the reel and the upper, and wherein the closure system includes an adjustable winding ratio having an input parameter and an output parameter, the output parameter being associated with the second segment of the cord.

13. The closure system of claim 12, wherein the reel is disposed on an upper of the article of footwear.

14. The closure system of claim 12, wherein the cord is at least partially concealed by the wrap.

15. The closure system of claim 12, wherein the cord is configured to exert a tightening force on the wrap to tighten the article of footwear.

16. The closure system of claim 12, wherein the first segment of the cord is configured to be pulled to actuate the closure system to tighten the footwear.

17. The closure system of claim 16, wherein the first segment of the cord is configured to be pulled away from the reel in a plurality of directions, wherein a first direction is associated with a first function of the closure system and a second direction is associated with a second function of the closure system, the first direction being different from the second direction, and the first function being different from the second function.

18. The closure system of claim 12, wherein the wrap is a continuous structure, and wherein the plurality of flaps extend from the forefoot region to a heel region of the footwear.

* * * * *